US010611566B1

(12) United States Patent
Campbell

(10) Patent No.: US 10,611,566 B1
(45) Date of Patent: Apr. 7, 2020

(54) SIDE LOADING GARBAGE TRUCK WITH FULL EJECT MECHANISM

(71) Applicant: Paul Campbell, Chandler, AZ (US)

(72) Inventor: Paul Campbell, Chandler, AZ (US)

(73) Assignee: Bruckner Truck Sales, Inc., Amarillo, TX (US)

( * ) Notice: Subject to any disclaimer, the term of this patent is extended or adjusted under 35 U.S.C. 154(b) by 305 days.

(21) Appl. No.: 15/168,670

(22) Filed: May 31, 2016

(51) Int. Cl.
*B65F 3/04* (2006.01)
*B65F 3/20* (2006.01)
*B65F 3/28* (2006.01)

(52) U.S. Cl.
CPC ..... *B65F 3/041* (2013.01); *B65F 3/201* (2013.01); *B65F 3/28* (2013.01)

(58) Field of Classification Search
CPC ..... B65F 3/041; B65F 3/201; B65F 3/28
See application file for complete search history.

(56) References Cited

U.S. PATENT DOCUMENTS 6,719,226 B2 * 4/2004 Rajewski ..... B02C 13/04 241/101.741
6,854,949 B2 * 2/2005 Huang ..... B65F 3/28 414/492
7,997,852 B1 8/2011 Campbell et al.
9,102,466 B2 * 8/2015 Neufeldt ..... B65F 3/08
9,156,611 B1 10/2015 Campbell et al.
2005/0135910 A1 * 6/2005 Pruteanu ..... B65F 3/201 414/517

* cited by examiner

*Primary Examiner* — Saul Rodriguez
*Assistant Examiner* — Ashley K Romano
(74) *Attorney, Agent, or Firm* — Sandy Lipkin

(57) ABSTRACT

A side loading garbage truck with a unique packing blade that creates a self-cleaning garbage truck without the need for manual clean outs and construction for the accomplishment of same. The packing blade includes a top vertical portion that is in a fixed position and a second bottom vertical portion that is retractable into a horizontal position to allow for repeated pass-throughs to collect all debris prior to emptying the garbage from the truck.

2 Claims, 10 Drawing Sheets

SIDE LOADING GARBAGE TRUCK WITH FULL EJECT MECHANISM

BACKGROUND OF THE INVENTION

Side loading garbage collection trucks are common in the field of trash, garbage, refuse and/or recyclable materials removal. Typically, the truck includes an arm at the side of the truck that grabs with a grabbing mechanism a trash can or other receptacle containing trash, garbage, refuse and/or recyclable materials. The grabbing mechanism is attached to an arm that travels along the side of the cab of the truck and into an opening called a hopper and dumps the trash, garbage, refuse and/or recyclable materials can therein. Once the garbage is inside the body of the trash truck, a packing blade pushes the garbage to the rear end of the truck to make room for more trash, garbage, refuse and/or recyclable materials and to optionally allow for expulsion through the rear of the trash truck once full.

One problem that often occurs is that some of the garbage is not grabbed by the packing blade on the push through. When garbage is left behind like this, the missed garbage needs to be manually removed by the operator. To accomplish this, the driver must climb inside the body of the trash truck. Additionally, a side door is required for access as is a floor clean-out trough to remove the missed garbage.

There is a need for a side loading trash truck engine design that overcomes the aforementioned shortcomings in the prior art.

SUMMARY OF THE INVENTION

The preferred embodiment of the instant inventions teaches a side loading garbage truck comprising: a chassis; a cab attached to said chassis; four or more wheels attached to said chassis; a side loader arm attached to said chassis rests at the side of and just behind said cab and terminates in gripping members to grip a garbage receptacle; a hopper portion into which garbage is placed in said truck by said side loader arm; a large hollow body attached to said chassis and behind said cab for placement therein of garbage through movement of said side loader arm; a horizontal channel that runs along both sides of said hollow body; a horizontal member that fits inside of said horizontal channel that is movable along said horizontal channel along said hollow body; a top blade that is attached to said horizontal member that is in a fixed vertical position; and a bottom blade that is attached to said horizontal member that is movable between a first vertical position and a second horizontal position.

An alternate embodiment of the instant invention teaches a method for collecting, transporting and ejecting garbage from a side loading trash truck safely without the need for the operator to enter the body of said side loading trash truck comprising the steps of: grabbing a trash receptacle with a side loading arm of said trash truck said trash truck further comprising: a hopper portion into which garbage is placed in said truck by said side loader arm; a large hollow body attached to said chassis and behind said cab for placement therein of garbage through movement of said side loader arm; a horizontal channel that runs along both sides of said hollow body; a horizontal member that fits inside of said horizontal channel that is movable along said horizontal channel along said hollow body; a top blade that is attached to said horizontal member that is in a fixed vertical position; and a bottom blade that is attached to said horizontal member that is movable between a first vertical position and a second horizontal position; raising said trash receptacle from the ground into said hopper while said bottom blade is in said first vertical position separating said hopper from said hollow body and dumping garbage from said garbage receptacle into said hopper; lowering said garbage receptacle to the ground and releasing said grabbing members; moving said bottom blade to the second horizontal position and moving said horizontal member in said horizontal position toward the direction of said hopper; lowering said bottom blade to the first vertical position and moving said horizontal member in said horizontal position away from said hopper and into said hollow body thereby compacting said garbage in said hollow body with no garbage escaping from said hollow body as it is being held in place by said fixed vertical top blade; continuing said operation until said hollow body is compact and full of garbage; transporting said trash truck to a landfill or transfer station with said bottom blade in said horizontal position over said hopper to prevent said garbage from exiting said truck through said hopper; upon arrival at said landfill or transfer station, raising said tailgate and moving said movable lower portion of said blade in said vertical position and then moving said horizontal member all the way through said hollow body and out of said trash truck through the raising of said tailgate thereby ejecting said garbage through the rear of said hollow body; moving said horizontal member in said horizontal position back to said hopper; lowering said bottom blade into said first vertical position; and lowering said tailgate.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The most basic embodiment of the instant invention is a side loading trash truck that has a two-piece, self-cleaning packer blade design that allows for the lower part of the blade to operate initially as a standard packing blade in that it pushes and packs material into the receiving body as prior art packing blades design would. Additionally, it can also push material out of the body on full eject models as with prior art designs. What is unique about the design of the instant invention is that the packing blade has two parts: a top portion that remains vertical and a bottom portion that is retractable along the radius of the internal surface of the hopper section of the inside of the truck.

The retracting function of the lower part of the packing blade is unique in that the lower part of the blade will sweep upward from its initial vertical position into a second horizontal position before the packing blade returns to the front end of the hopper. Once the packing blade returns to the front end of the hopper, it returns to the vertical position for a second pass through, thereby moving any refuse that may have been missed during the initial pass through. Because of this function, there is no need for a side door for the operator to enter the body and there is no floor clean-out required for refuse removal. In this sense, the retractable bottom portion of the packing blade creates a self-cleaning side loading garbage truck.

Figure 1:
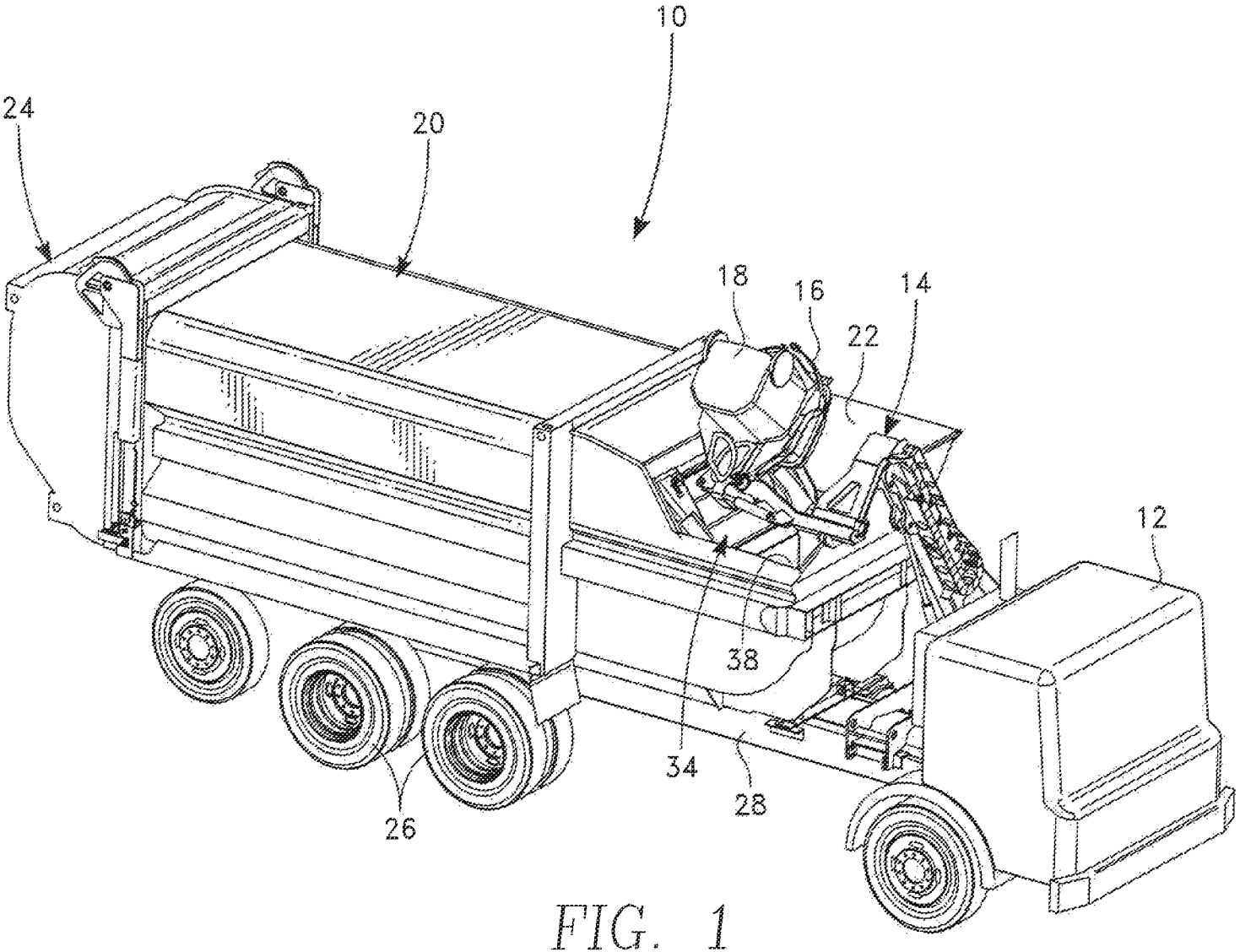
FIG. 1 is a perspective view of the trash truck of the instant invention dumping trash into the hopper from the side arm.

FIGS. 1-8 show various views of the trash truck 10 in various states of operation. In FIG. 1, the truck 10 is empty. The front components of the truck 10 include the cab 12, the side loader arm 14 and the grabbing members 16. Behind the cab 12 is the body 20 into which garbage is collected through a hopper 22. At the rear of the body 20 is a tailgate 24 that opens for the ejection of collected garbage.

Wheels 26 are attached to the chassis 28 in order for the vehicle to move. The side loader arm 14 is also attached to the truck 10 and is movable in a direction from the ground up to the top of the hopper 22. The grabbing members 16 of the side loader arm 14 are used to pick up a garbage container 18 and the side loader arm 14 travels vertically parallel to the cab 12 to the top of the hopper 22 where the garbage container is dumped and the garbage 42 therein transferred through the hopper 22 into the body 20 of the truck 10. The side arm 12 is controlled from inside the cab 12 by the operator (not shown).

Inside the body 20 of the truck 10 is a horizontal channel 30 that acts as a guide into which a horizontal portion 32 of the packing blade 34 sits and travels. The packing blade 34 is divided into an upper portion 36, which remains vertical at all times and a lower portion 38 that is retractable between a first vertical position and a second horizontal position. Hydraulic cylinders 40 are used to push the packing blade 34 and its horizontal portion along the horizontal channel 30 in order to move garbage 42 from the front portion of the truck 10 to the rear portion and eventually ejected out through the back when the tailgate 24 is opened.

FIG. 1 shows a perspective view of the truck 10 of the instant invention in operation. The truck has a main body 20 with a cab 12 on one end and a tailgate 24 on the opposite end. Behind the cab 12 is the hopper 22 into which garbage is dumped for the side loader arm 14 as it grips a garbage receptacle 18 with its gripping members 16. This full eject mechanism using the tailgate 24 rather than a dumping body type of truck allows for greater safety in dumping in soft landfills. The driver does not have to get out of the cab 12 and into the body 20 to clean refuse because of the unique blade mechanism inside. At this point when the garbage is being dropped into the hopper 22 the packer blade 34 is in its home, vertical position 38 at the point where the hopper 22 and the body 20 interface.

Figure 2:
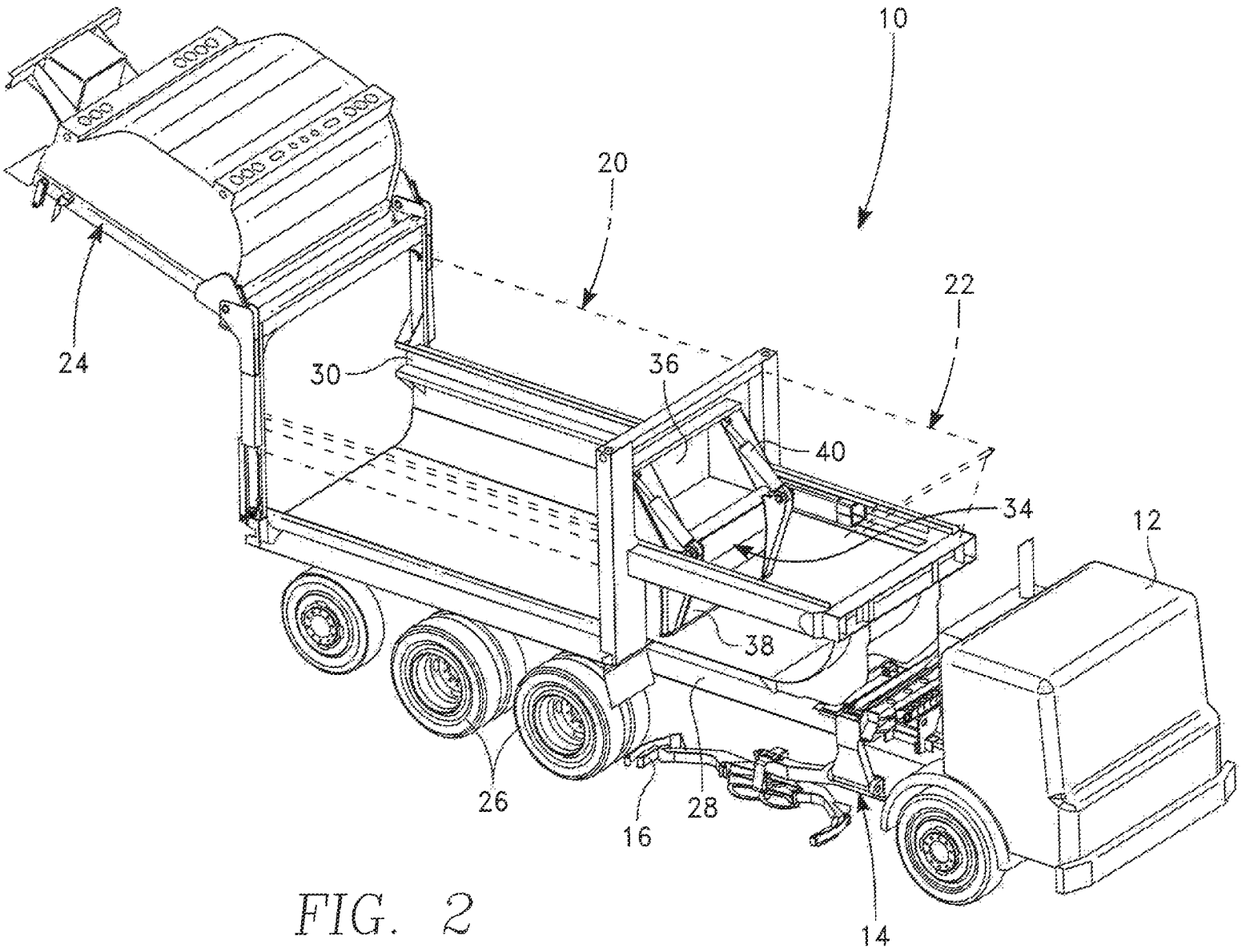
FIG. 2 is a perspective view of the trash truck of the instant invention showing the internal workings and with the pack blade in the home position.
Figure 3:
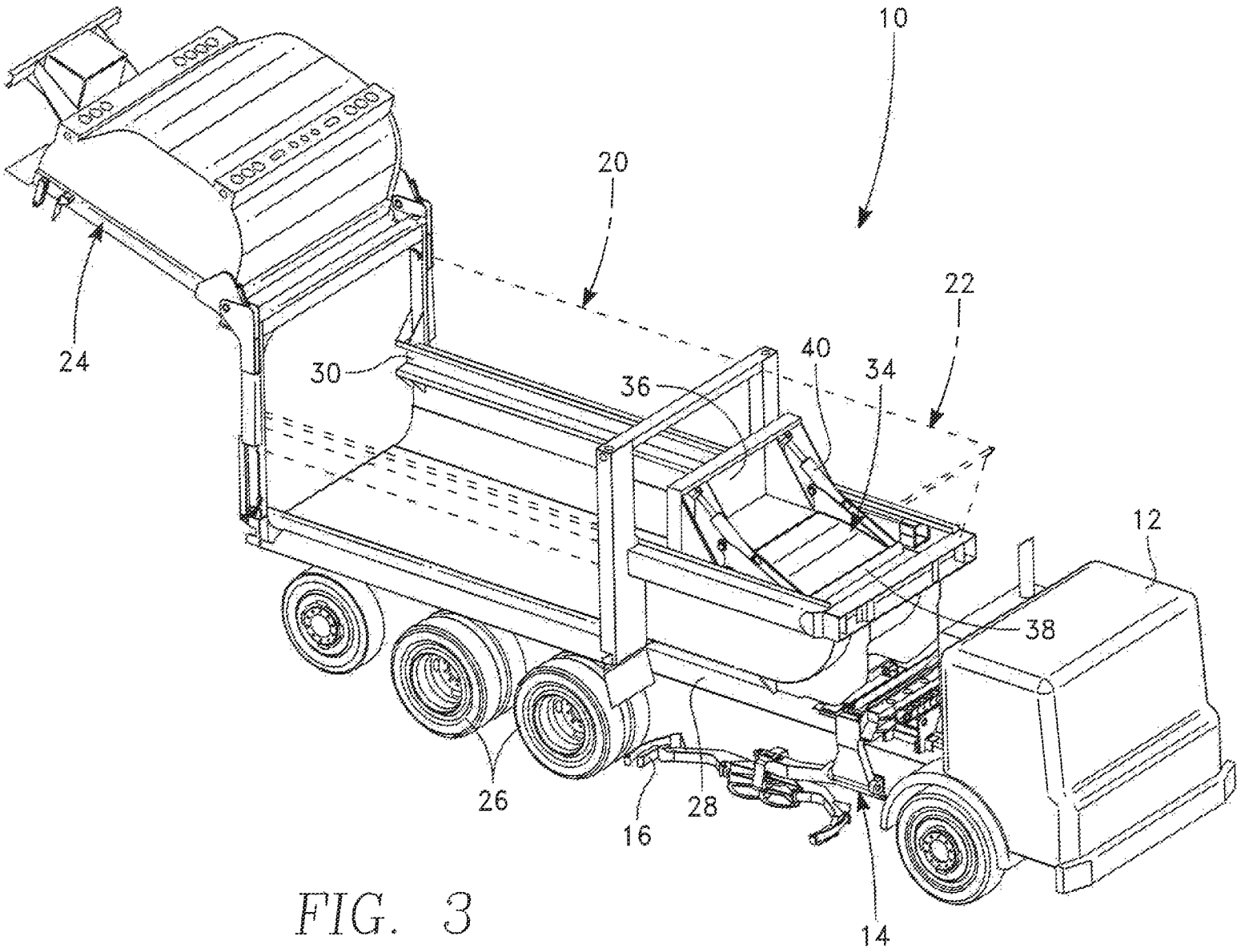
FIG. 3 is a perspective view of the trash truck of the instant invention showing the internal workings with the pack blade in the first operating position.

FIG. 2 is a perspective view of the truck 10 wherein the internal workings are visible and the tailgate 24 is open. The packing blade 34 is in the same position as it is in FIG. 1, i.e., where it sits when garbage is being dumped into the hopper 22. The vertical portion 38 of the packing blade 34 separates the body 20 from the hopper 22. This is the home position of the blade 34. The blade 34 is located at the rear of the hopper 22 and in the vertical position 38. In operation, the vertical portion 38 of the blade 34 will be moved up into the horizontal position as seen in FIG. 3. It will then slide forward through the horizontal channel 30 to the front of the hopper 22 as seen in FIG. 3. This position allows the blade 34 to go over the top of the refuse in the hopper 22 and also acts as a hopper cover in the traveling position.

In FIG. 3 the blade operation is seen in its second position. The blade 34 is all the way in front of the hopper 22 in a horizontal position. The blade 34 will now sweep down while the vertical portion 36 remains in place during the entire operation. The hydraulic arms connect the movable portion 36 of the blade 34 to the upper fixed portion 36 and also move the vertical fixed portion 32 of the blade 34 in the horizontal channel 30 along the body 20 of the truck to either eject garbage or return to the home position. Once in this second position, the blade 34 will sweep down into the vertical position 38 containing the refuse behind the blade 34. The blade 34 will then be slid rearward along the horizontal channel 30 to the body transition pushing the refuse into the body area 20. This operation will continue through all of the packing functions until the body 20 is packed out. The hopper 22 can also be packed full with the blade 34 covering the refuse during transport.

Figure 4:
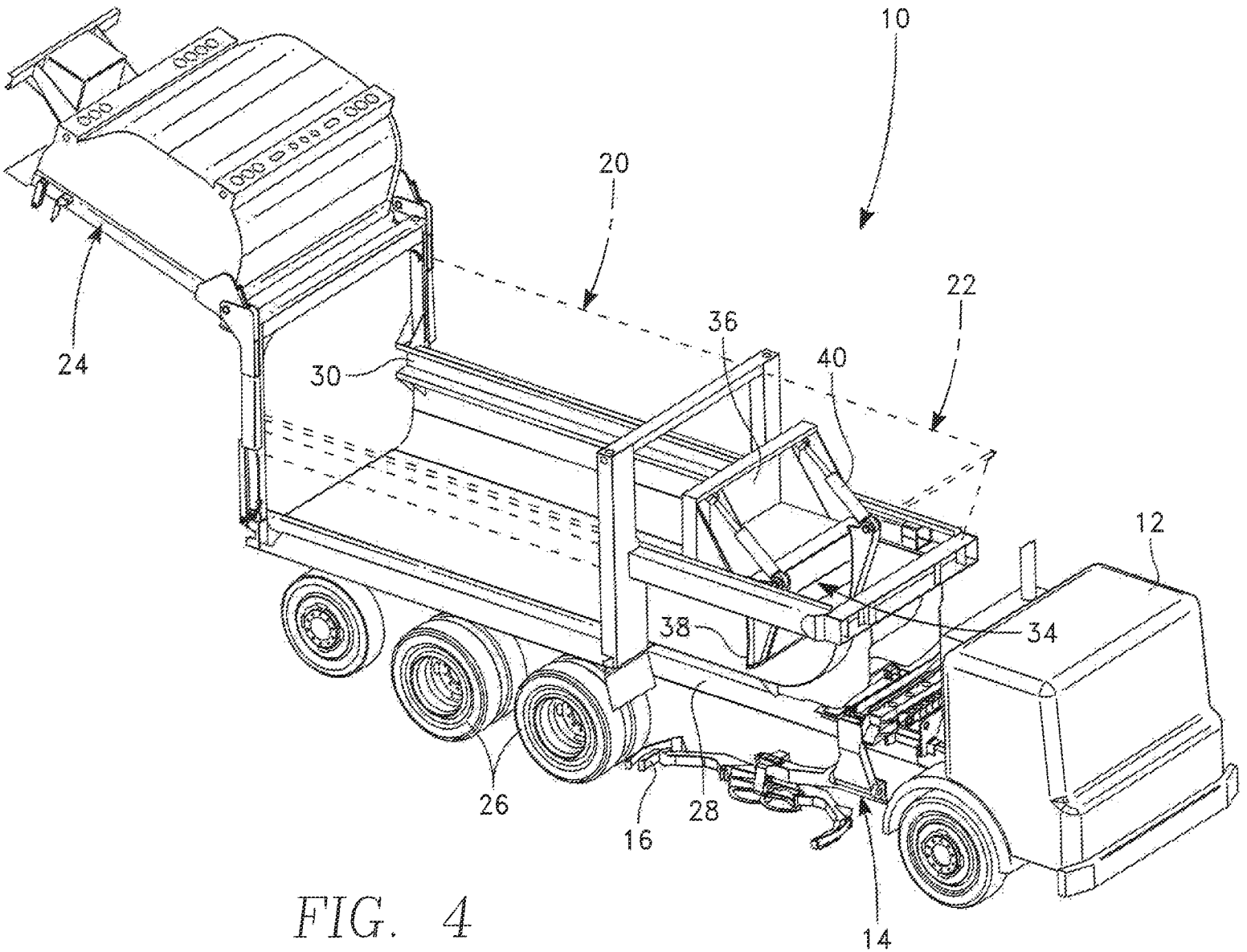
FIG. 4 is a perspective view of the trash truck of the instant invention showing the internal workings with the pack blade in the second operating position.
Figure 5:
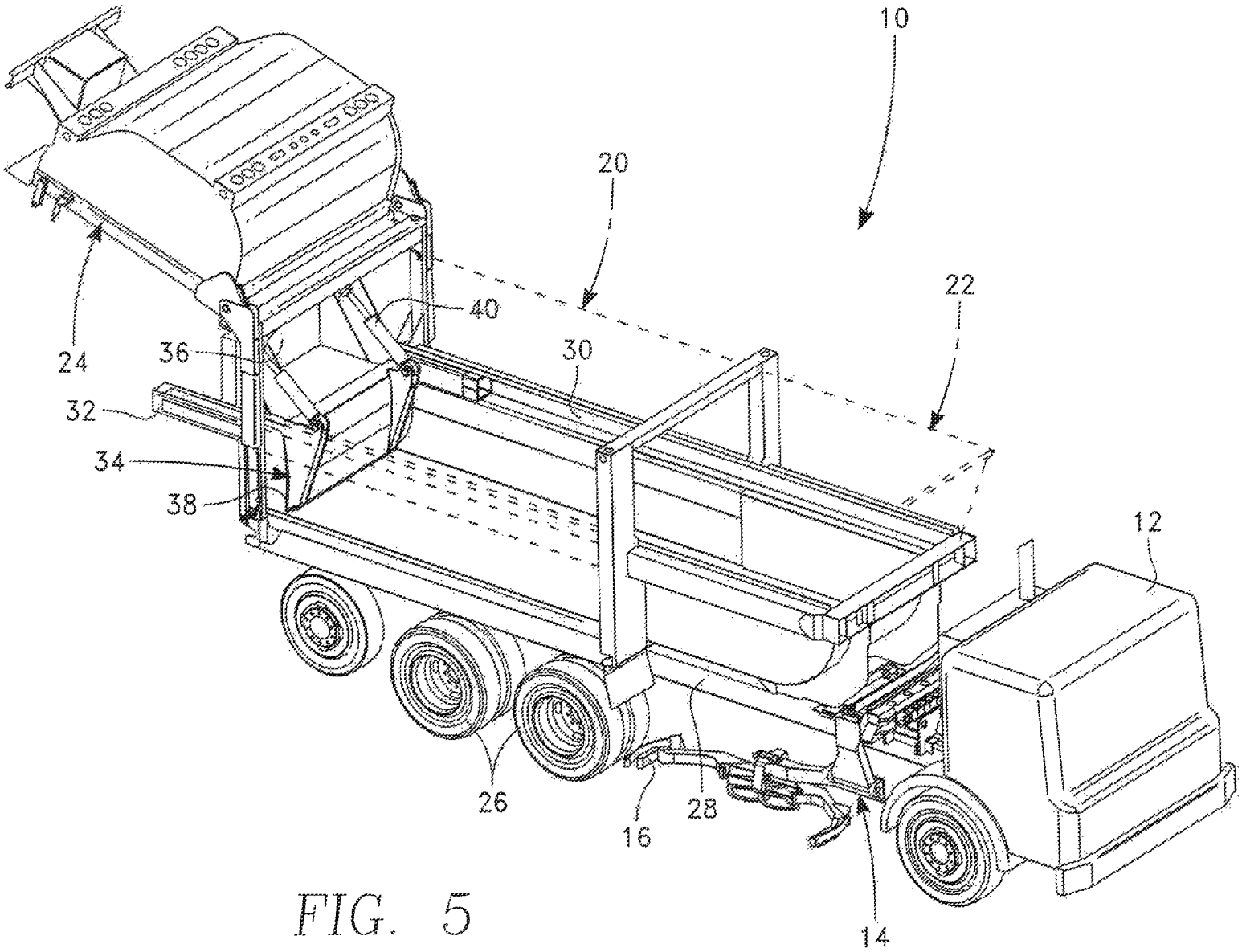
FIG. 5 is a perspective view of the trash truck of the instant invention showing the internal workings with the pack blade in the third operating full eject position.

The full eject function is when at the landfill or transfer station, the tailgate 24 is raised and the packer blade 34 is activated from the hopper cover position, i.e., horizontal to the sweep down function, i.e, the vertical position 38 (See FIG. 4). The slide function along the horizontal channel 30 with the horizontal fixed portion 32 of the blade 34 is then activated to begin pushing the garbage out of the hopper 22 and body 20 and out through the tailgate 24 (See FIG. 5).

Figure 6:
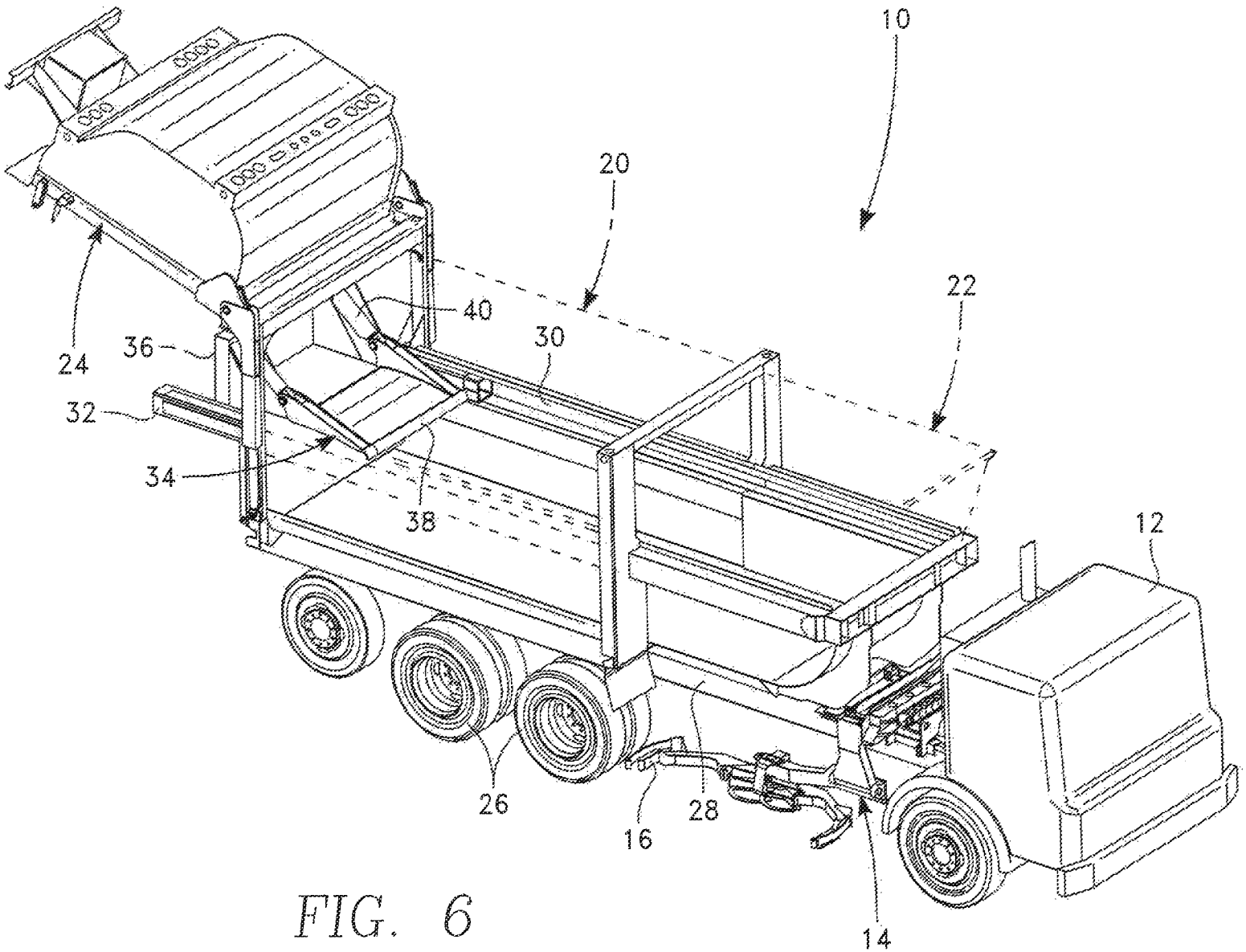
FIG. 6 is a perspective view of the trash truck of the instant invention showing the internal workings with the pack blade in the fourth operating position after the dump load has been fully ejected.
Figure 7:
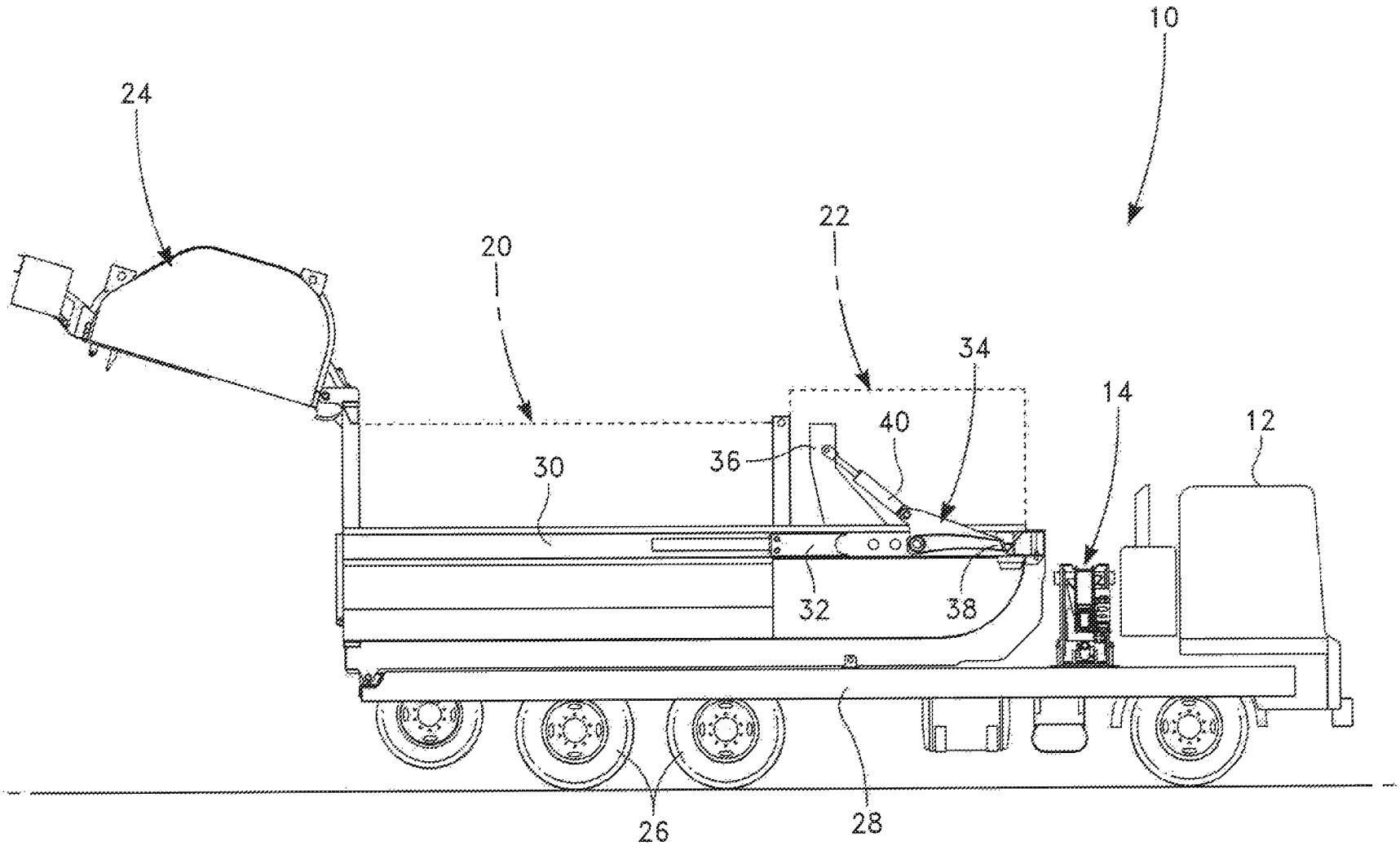
FIG. 7 is a side view of the trash truck of the instant invention showing the internal workings with the pack blade in the first operating position as seen in FIG. 3.
Figure 7A:
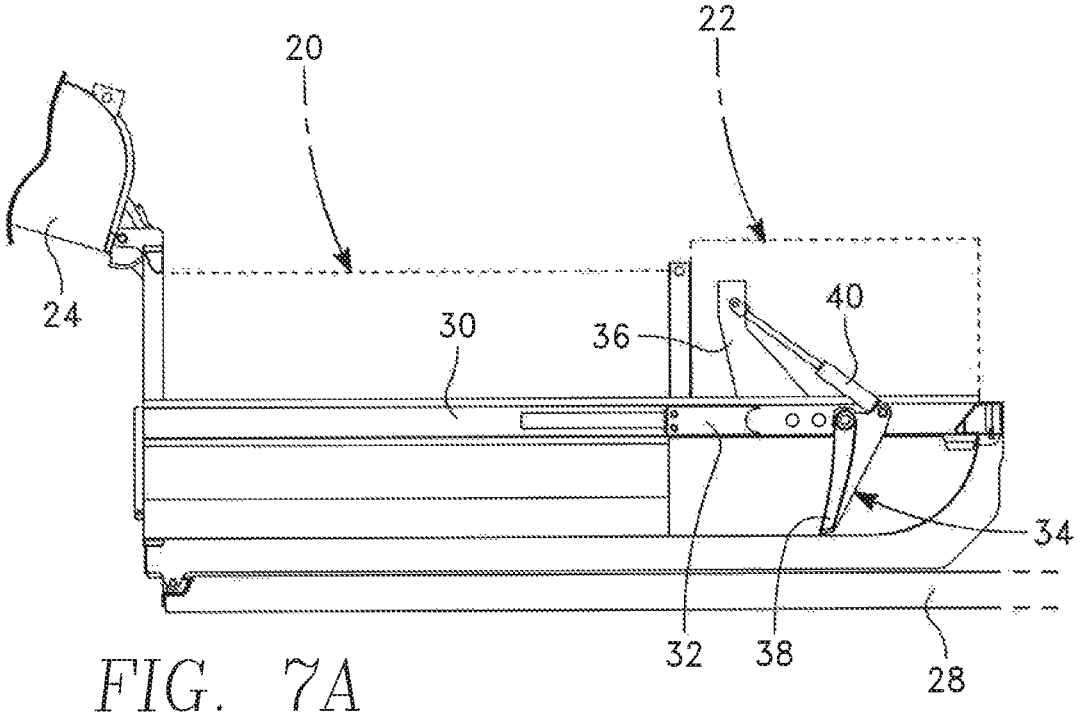
FIG. 7A is a side view of the body of the truck of the instant invention in preparation of the ejection of trash with the tailgate open.
Figure 7B:
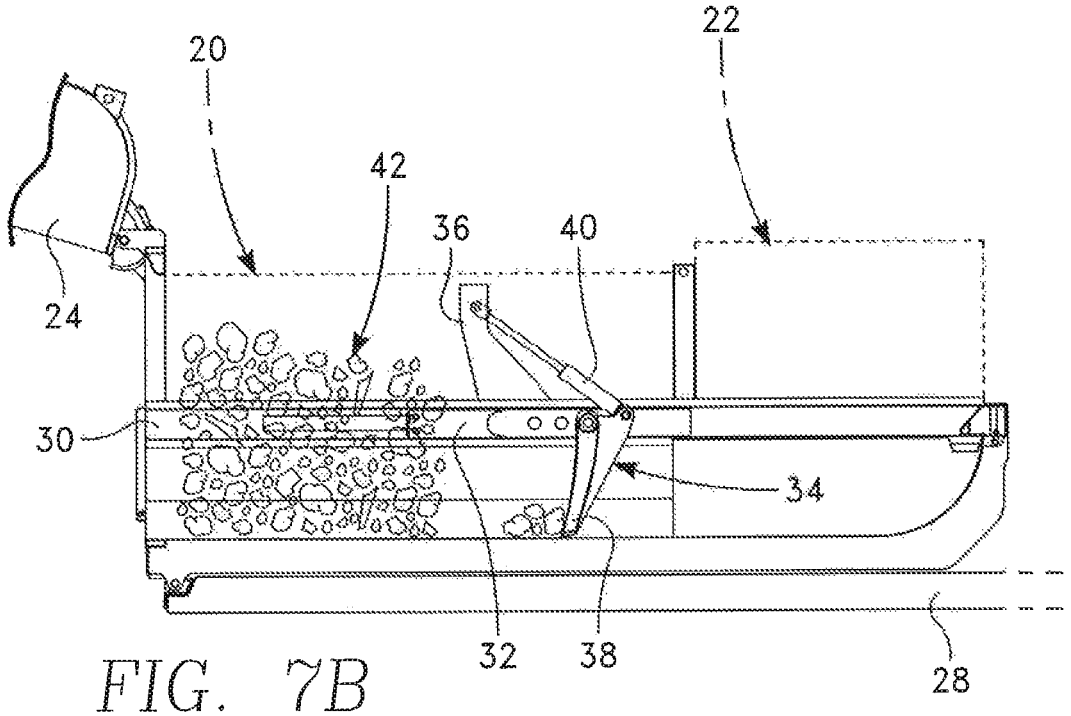
FIG. 7B is a side view of the body of the truck of the instant invention starting the ejection of trash with the tailgate open.
Figure 7C:
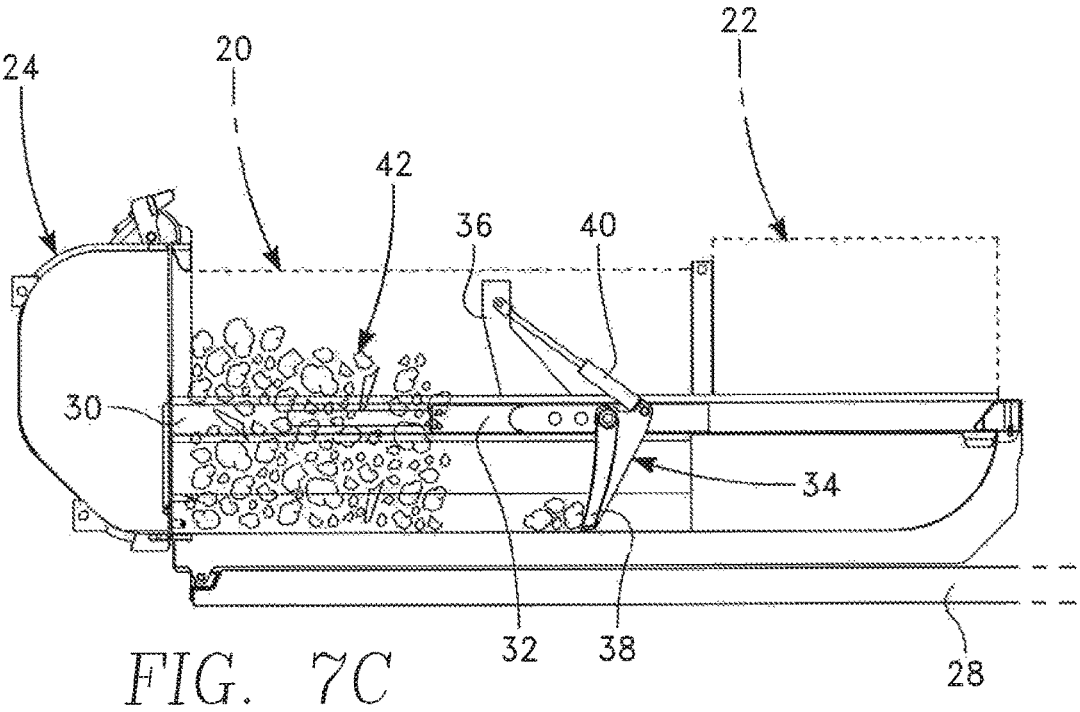
FIG. 7C is a side view of the body of the truck of the instant invention compacting trash with the tailgate closed.
Figure 7D:
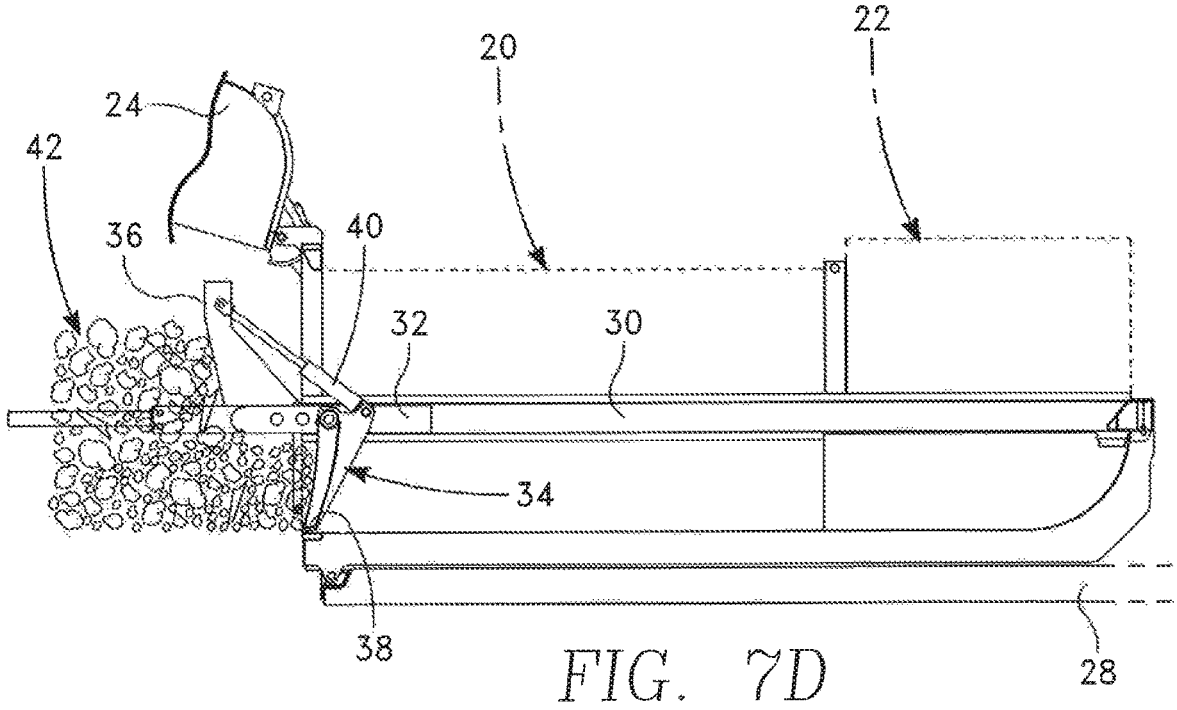
FIG. 7D is a side view of the body of the truck of the instant invention ejecting the compacted trash of FIG. 7C with the tailgate open.
Figure 8:
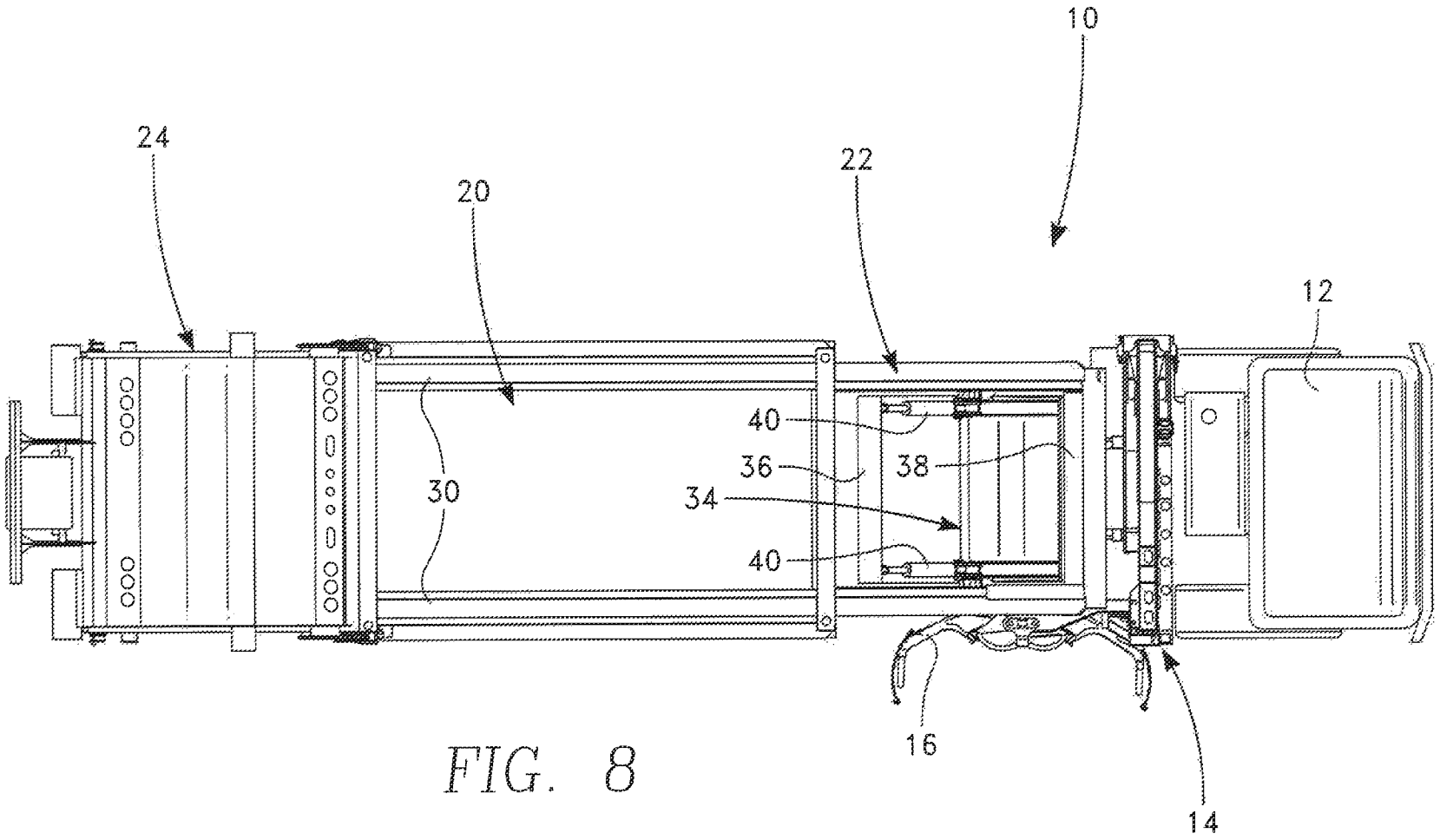
FIG. 8 is a top view of the trash of the instant invention showing the internal workings with the pack blade in the first operating position as seen in FIG. 3.

FIG. 6 shows the operation of the blade 34 after the garbage has been ejected from the body 20 by the blade 34. The next function is to return the packer blade 34 to the home position (See. FIG. 2) at the rear of the hopper 22 and the tailgate 24 is lowered. The blade 34 is in the horizontal position, it is slid forward along the horizontal channel 30 with the fixed vertical portion 32 of the blade 34 and the tailgate 24 is lowered. This operation is also shown in a side view of the body alone with garbage 42 inside of the body 20 in FIGS. 7A-7D.

The foregoing description of the preferred embodiments of the invention has been presented for the purposes of illustration and description. It is not intended to be exhaustive or to limit the invention to the precise form disclosed. Many modifications and variations are possible in light of the above teaching, including but not limited to the mixing and matching of various elements described herein. It is intended that the scope of the invention not be limited by this detailed description, but by the claims and the equivalents to the claims appended hereto.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A side loading garbage truck comprising:

a chassis;

a cab attached to said chassis;

four or more wheels attached to said chassis;

a side loader arm attached to said chassis that rests at the side of and just behind said cab and terminates in gripping members to grip a garbage receptacle;

a hopper portion into which garbage is placed in said truck by said side loader arm;

a large hollow body attached to said chassis and behind said cab for placement therein of garbage through movement of said side loader arm;

a horizontal channel that runs along both sides of said hollow body;

a packing blade further comprising a horizontal member that fits inside of said horizontal channel that is movable along said horizontal channel along said hollow body;

a top blade portion that is attached to said horizontal member that is in a fixed vertical position; and a bottom blade portion that is attached to said horizontal member that is movable between a first vertical position and a second horizontal position wherein said top blade portion and said bottom blade portion form an integral unit as attached to said horizontal member;

one or more hydraulic cylinders attached to said top blade portion and said bottom blade portion that allows said bottom blade portion to be movable between said first vertical position and said second horizontal position; and a tailgate attached to said truck at the end distal said cab wherein said tailgate is in the closed position said is garbage secured therein and when in the open position said garbage can be ejected out said distal end of said truck.

2. A method for collecting, transporting and ejecting garbage from a side loading trash truck safely without the need for the operator to enter the body of said side loading trash truck comprising the steps of:

grabbing a trash receptacle with a side loading arm of said trash truck said trash truck further comprising:

a chassis;

a cab attached to said chassis;

four or more wheels attached to said chassis;

a side loader arm attached to said chassis that rests at the side of and just behind said cab and terminates in gripping members to grip a garbage receptacle;

a hopper portion into which garbage is placed in said truck by said side loading arm;

a large hollow body attached to said chassis and behind said cab for placement therein of garbage through movement of said side loading arm;

a horizontal channel that runs along both sides of said hollow body;

a packing blade further comprising a horizontal member that fits inside of said horizontal channel that is movable along said horizontal channel along said hollow body;

a top blade portion that is attached to said horizontal member that is in a fixed vertical position; and a bottom blade portion that is attached to said horizontal member that is movable between a first vertical position and a second horizontal position wherein said top blade portion and said bottom blade portion form an integral unit as attached to said horizontal member;

one or more hydraulic cylinders attached to said top blade portion and said bottom blade portion that allows said bottom blade portion to be movable between said first vertical position and said second horizontal position; and a tailgate attached to said truck at the end distal said cab wherein said tailgate is in the closed position said is garbage secured therein and when in the open position said garbage can be ejected out said distal end of said truck raising said trash receptacle from the ground into said hopper while said bottom blade portion is in said first vertical position separating said hopper from said hollow body and dumping garbage from said garbage receptacle into said hopper;

lowering said garbage receptacle to the ground and releasing said grabbing members;

moving said bottom blade portion to the second horizontal position and moving said horizontal member in said horizontal position toward the direction of said hopper;

lowering said bottom blade portion to the first vertical position and moving said packing blade away from said hopper and into said hollow body thereby compacting said garbage in said hollow body with no garbage escaping from said hollow body as it is being held in place by said packing blade;

continuing said operation until said hollow body is compact and full of garbage;

transporting said trash truck to a landfill or transfer station with said bottom blade portion in said horizontal position over said hopper to prevent said garbage from exiting said truck through said hopper;

upon arrival at said landfill or transfer station, raising said tailgate and moving said bottom blade portion of said packing blade in said first vertical position all the way through said hollow body and out of said trash truck through the raising of said tailgate thereby ejecting said garbage through the rear of said hollow body;

moving said bottom blade portion of said packing blade into said second horizontal position;

moving said packing blade position back to said hopper;

lowering said bottom blade portion into said first vertical position;

moving said packing blade back toward said distal end of said truck to remove any remaining garbage; and lowering said tailgate.

* * * * *